US006938799B1

(12) United States Patent
Berntsen et al.

(10) Patent No.: US 6,938,799 B1
(45) Date of Patent: Sep. 6, 2005

(54) SEALANT/ADHESIVE GUN

(76) Inventors: Kenneth R. Berntsen, P.O. Box 321, Sagle, ID (US) 83860; Deborah A. Berntsen, P.O. Box 321, Sagle, ID (US) 83860

( * ) Notice: Subject to any disclaimer, the term of this patent is extended or adjusted under 35 U.S.C. 154(b) by 207 days.

(21) Appl. No.: 10/637,906

(22) Filed: Aug. 11, 2003

(51) Int. Cl.[7] ..... B67D 5/52
(52) U.S. Cl. ..... 222/137; 222/145.5; 222/327; 222/391
(58) Field of Search ..... 222/136, 137, 222/327, 391, 145.1, 145.5, 145.6

(56) References Cited

U.S. PATENT DOCUMENTS

| | | | | |
|---|---|---|---|---|
| 2,236,727 A | | 4/1941 | Dewees | |
| 2,833,444 A | | 5/1958 | Sherbondy | |
| 3,311,265 A | * | 3/1967 | Creighton, Jr. et al. | 222/137 |
| 3,658,213 A | | 4/1972 | Plumer | |
| 4,471,888 A | * | 9/1984 | Herb et al. | 222/137 |
| 4,566,610 A | * | 1/1986 | Herb | 222/137 |
| 5,137,181 A | * | 8/1992 | Keller | 222/137 |
| 5,353,971 A | | 10/1994 | Vaziri | |
| 5,392,956 A | * | 2/1995 | Keller | 222/137 |
| 5,400,925 A | * | 3/1995 | Simmen | 222/137 |
| 5,450,988 A | | 9/1995 | Jerdee | |
| 5,722,829 A | * | 3/1998 | Wilcox et al. | 222/137 |
| 5,755,362 A | * | 5/1998 | Rodriguez et al. | 222/391 |
| 5,875,928 A | * | 3/1999 | Muller et al. | 222/327 |
| 6,325,249 B1 | * | 12/2001 | Keller | 222/137 |
| 6,382,466 B1 | * | 5/2002 | Schneider et al. | 222/137 |

* cited by examiner

*Primary Examiner*—Kenneth Bomberg
(74) *Attorney, Agent, or Firm*—Donald R. Schoonover

(57) ABSTRACT

A gun is used to discharge sealant and/or adhesive or a mixture thereof. The gun is adapted to accommodate one or two containers of sealants and/or adhesives and can mix the contents of those containers during dispensing.

4 Claims, 3 Drawing Sheets

SEALANT/ADHESIVE GUN

BACKGROUND OF THE INVENTION

1. Field of the Invention

The present invention relates to the general art of dispensing, and to the particular field of dispensers with discharge assistants and a removable container and a follower.

2. Discussion of the Related Art

Many construction and repair jobs require the use of sealants and/or adhesives or a combination thereof. Such jobs as occur in the construction and repair industry as well as in work on aircraft, spacecraft, automobiles and the like, often require the placement of adhesives and/or sealants at specific locations.

Therefore, the art contains many examples of devices that dispense such material to selected locations. Caulking guns, adhesive guns and the like are examples of such devices.

However, these known devices have several drawbacks which inhibit the effective use thereof. For example, some jobs require a product that differs from the product used in other jobs. While, on a broad level, this requirement can be met by changing the container of product for each job, presently available devices cannot accurately and precisely meet this requirement.

Therefore, there is a need for a sealant/adhesive dispensing device that can dispense product that is accurately and precisely formed for a particular application.

More specifically, some jobs require a specific mixture of products which may differ from a product or a mixture used in other jobs. For example, one job may require a mixture of two different types of adhesive, while another job may require the use of a product that is a mixture of two other types of adhesive.

Therefore, there is a need for a sealant/adhesive dispensing device that can dispense product that is a mixture of components.

To be most versatile, and hence most efficient and cost effective, the device should be adaptable for use in a wide variety of applications. That is, the device should be useable in many different construction jobs as well as in many other applications as well. Thus, the device should be amenable to mixing product in a wide variety of ratios so a wide variety of applications can be obtained.

Therefore, there is a need for a sealant/adhesive dispensing device that can dispense product that is a mixture of components that is in a wide variety of ratios.

Some products require mixing to be activated and are kept separated until application. In the past, this has required a workman to use two application devices, which can be cumbersome and time consuming. If the product is to be applied in difficult-to-reach locations, problems associated with this double application requirement are exacerbated.

Therefore, there is a need for a sealant/adhesive dispensing device that can dispense two products at the same time and mix those products as required during the dispensing process.

However, since some devices of this type are discarded after one or more uses, the device should be inexpensive. Otherwise, the cost of the device will inhibit its commercial success.

PRINCIPAL OBJECTS OF THE INVENTION

It is a main object of the present invention to provide a sealant/adhesive dispensing device that can dispense product that is accurately and precisely formed for a particular application.

It is another object of the present invention to provide a sealant/adhesive dispensing device that can dispense product that is a mixture of components.

It is another object of the present invention to provide a sealant/adhesive dispensing device that can dispense product that is a mixture of components that is in a wide variety of ratios.

It is another object of the present invention to provide a sealant/adhesive dispensing device that can dispense two products at the same time and mix those products as required during the dispensing process.

It is another object of the present invention to provide a sealant/adhesive dispensing device that can dispense two products at the same time and mix those products as required during the dispensing process while remaining inexpensive.

SUMMARY OF THE INVENTION

These, and other, objects are achieved by a device for dispensing product such as sealants and/or adhesives in various ratios which comprises a handle unit; a product container mounting element mounted on the handle unit; a U-shaped drive element slidably mounted on the handle unit to move between a retracted position and a forward position, the drive element including a bight section and two legs, and a plurality of teeth on each leg; a trigger pivotally mounted on the hollow housing to move between a drive position and a release position; a drive element-moving mechanism in the handle unit, the trigger being connected to the drive element-moving mechanism, the drive element-moving mechanism being connected to the drive element to move the drive element from the retracted position to the forward position; a return spring connected to the drive-element moving mechanism and to the handle, the trigger moving the drive element-moving mechanism against the bias of the return spring; two pawls in the drive element-moving mechanism, each pawl being movable between a drive element driving position and a drive element release position and having pawl teeth engaging pawl teeth of the other pawl and a tooth-engaging leg which is located to engage a tooth of the teeth on the legs of the drive element when in the drive element-driving position; a pawl control spring mounted on the handle unit and abutting one of the pawls, the pawl control spring biasing the pawls toward the drive element-driving position; a release lever mounted on the handle and connected to the pawls to move those pawls into a drive element release position when the release lever is activated; and a product container adapted to be mounted on the product container-mounting element on the handle in a position to be engaged by one leg of the drive element as the drive element is moved toward the forward position of the drive element.

The device embodying the present invention thus is able to dispense a single product or mix two products together during the dispensing process. The device is also able to accommodate two different product containers so product can be mixed in a wide variety of ratios with a wide variety of results. Thus, for example, products that require mixing for activation can be dispensed from the single device and can be dispensed into difficult-to-reach locations from a single device. Thus, the device embodying the present invention is versatile, easy to use, amenable to a wide variety of applications, all while being inexpensive.

BRIEF DESCRIPTION OF THE DRAWING FIGURES

DETAILED DESCRIPTION OF THE PREFERRED

Figures 1, 2:
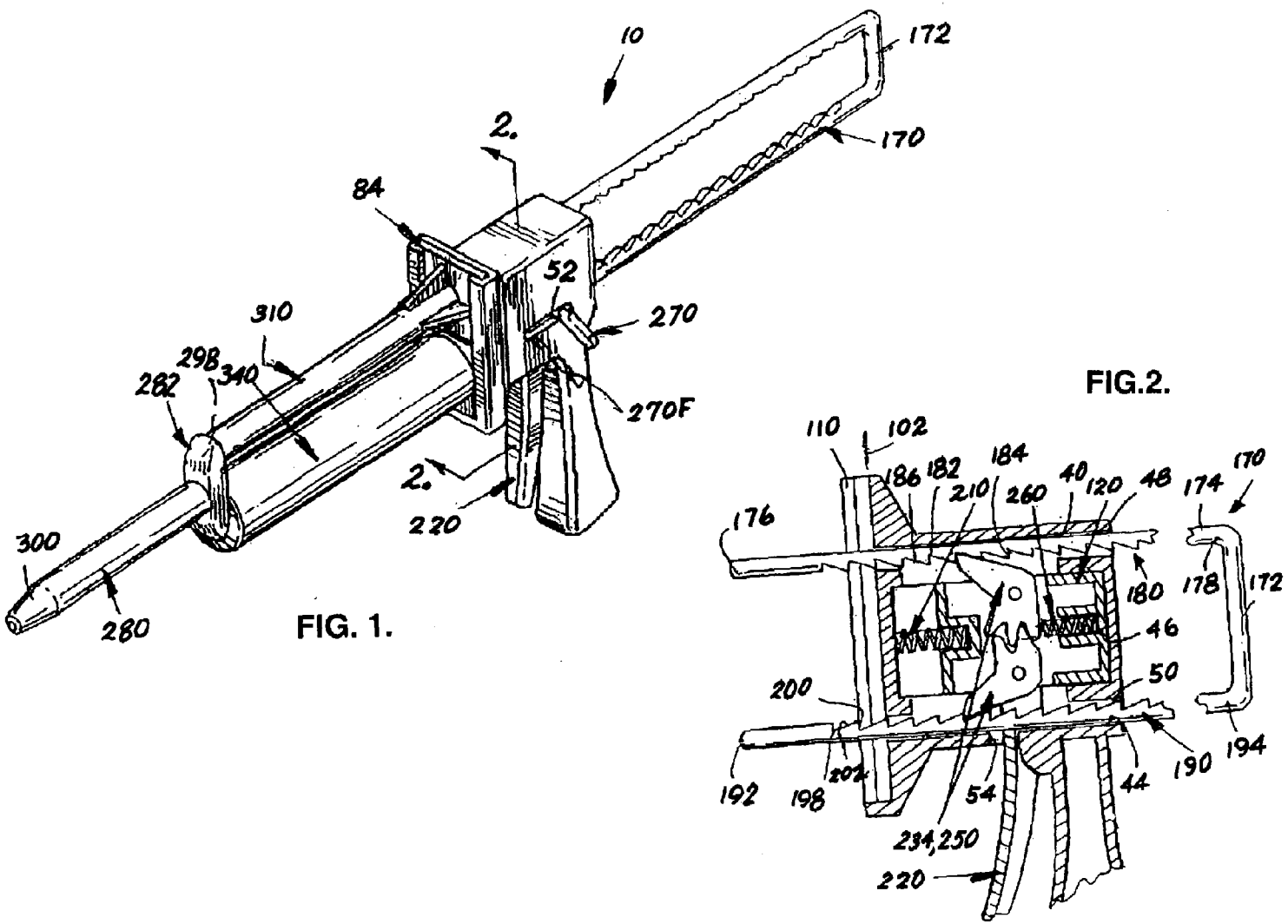
FIG. 1 is a perspective view of a product-dispensing device embodying the present invention.
FIG. 2 is a view taken along line 2—2 of FIG. 1.

Other objects, features and advantages of the invention will become apparent from a consideration of the following detailed description and the accompanying drawings.

Referring to the Figures, it can be understood that the present invention is embodied in a device 10 for dispensing product such as sealants and/or adhesives in various ratios. Device 10 comprises a handle unit 12, which includes a hollow housing 14 having a rear wall 16, a top wall 18, a bottom wall 20, and first and second side walls 22 and 24. A hollow interior 26 is defined between the rear wall 16, the top wall 18, the bottom wall 20 and the first and second side walls 22, 24. Unit 12 further includes an open front 28, a longitudinal axis 30 extending between the rear wall 16 and the open front 28, a transverse axis 32 extending between the first and second side walls 22, 24 and a height axis 34 extending between the top wall 18 and the bottom wall 20. An interior surface 40 is on the top wall 18 adjacent to the hollow interior 26, an interior surface 42 is on each side wall of the first and side walls 22, 24 adjacent to the hollow interior 26, an interior surface 44 is on the bottom wall 20 adjacent to the hollow interior 26, and an interior surface 46 is on the rear wall 16 adjacent to the hollow interior 26. A first hole 48 is defined through the rear wall 16 adjacent to the top wall 18 and a second hole 50 is defined through the rear wall 16 adjacent to the bottom wall 20. A slot 52 is defined through the first side wall 22 and extending in the direction of the longitudinal axis 30. A trigger slot 54 is defined through the bottom wall 20.

A guide unit 60 is mounted in the hollow interior 26 of the hollow housing 14. Guide unit 60 includes a front end 62 located adjacent to the open front 28 of the hollow housing 14, first and second guide rails 64 and 66 extending between the open front 28 and the rear wall 16 of the hollow housing 14 adjacent to the interior surfaces 42 of the first and second side walls 22, 24 near the bottom wall 20, and third and fourth guide rails 68 and 70 extending between the open front 28 and the rear wall 16 of the hollow housing 14 adjacent to the interior surfaces 42 of the first and second side walls 22, 24 near the top wall 18. A lower guide groove 72 is located near the interior surface 44 of the bottom wall 20 between the first and second guide rails 64, 66, an upper guide groove 74 is located near the interior surface 40 of the top wall 18 between the third and fourth guide rails 68, 70. A first side guide groove 76 is located near the first side wall 22 of the hollow housing 14 between the first and third guide rails 64, 68, and a second side guide groove 78 is located near the second side wall 24 of the hollow housing 14 between the second and fourth guide rails 66, 70. A handle 80 is attached to the bottom wall 20 of the hollow housing 14.

A product container-mounting element 84 is mounted on the hollow housing 14 adjacent to the open front 28 of the hollow housing 14. Element 84 includes a base portion 86, a bottom portion 88, a first side 90, a second side 92, a first channel-defining element 94 on the first side 90 of the product container-mounting element 84 and a second channel-defining element 96 on the second side 92 of the product container-mounting element 84. A passage 100 is defined through the product container-mounting element 84 and forms a continuation of the hollow interior 26 of the hollow housing 14 when the product container mounting-element 84 is mounted on the hollow housing 14. Passage 100 is contained in a plane 102, and the guide rails each have an end 104 that is located adjacent to the plane 102 containing the passage 100. The guide grooves extend between the open front 28 of the hollow housing 14 and the rear wall 16 of the hollow housing 14.

A front plate 110 is attached to the hollow housing 14 to cover the open front 28 of the hollow housing 14 when the front plate 110 is in place on the hollow housing 14.

A mechanism housing 120 is slidably mounted in the hollow interior 26 of the hollow housing 14 on the guide rails in the first and second side guide grooves 76, 78 to move between a forward location (see FIG. 4B) adjacent to the open front 28 of the hollow housing 14 and a rear position (see FIG. 4A) adjacent to the rear wall 16 of the hollow housing 14. The mechanism housing 120 includes a top wall 122, a bottom wall 124, a first side wall 126, a second side wall 128, a rear end wall 130, a front end wall 132, and a hollow interior 134. A longitudinal axis 136 extends between the front end wall 132 of the mechanism housing 120 and the rear end wall 130 of the mechanism housing 120. Longitudinal axis 136 of the mechanism housing 120 extends in the direction of the longitudinal axis 30 of the hollow housing 14 when the mechanism housing 120 is mounted inside the hollow housing 14. A transverse axis 138 extends between the first side wall 126 of the mechanism housing 120 and the second side wall 128 of the mechanism housing 120. The transverse axis 138 of the mechanism housing 120 extends in the direction of the transverse axis 32 of the hollow housing 14 when the mechanism housing 120 is mounted inside the hollow housing 14. A height axis 140 extends between the top wall 122 of the mechanism housing 120 and the bottom wall 124 of the mechanism housing 120. The height axis 140 of the mechanism housing 120 extends in the direction of the height axis 34 of the hollow housing 14 when the mechanism housing 120 is mounted inside the hollow housing 14. Two holes 150 and 152 are defined through the first side wall 126 of the mechanism housing 120 and are spaced apart from each other in the direction of the height axis 140 of the mechanism housing 120. A blind-ended tube 154 is mounted on the front wall 132 of the mechanism housing 120 and extends into the hollow interior 134 of the mechanism housing 120. An opening 156 is defined through the top wall 122 of the mechanism housing 120, and an opening 158 is defined through the bottom wall 124 of the mechanism housing 120. A blind-ended tube 160 is mounted on the rear wall 130 of the mechanism housing 120 in the hollow interior 134 of the mechanism housing 120. Blind-ended tube 160 on the rear wall 130 of the mechanism housing 120 is aligned with blind-ended tube 154 mounted on the front wall 132 of the mechanism housing 120.

A U-shaped drive element 170 is slidably mounted on the hollow housing 14 to move in the direction of the longitudinal axis 30 of the hollow housing 14 between a retracted position (see FIG. 1) and a forward position (see FIG. 4C) on the hollow housing 14. U-shaped drive element 170 includes a bight section 172. The bight section 172 is located closely adjacent to the rear wall 16 of the hollow housing 14 when the drive element 170 is in the forward position and is spaced apart from the rear wall 16 of the hollow housing 14 when the drive element 170 is in the retracted position.

A first leg 174 extends through first hole 48 defined through the rear wall 16 of the hollow housing 14 and into the upper guide groove 74 of the guide unit 60 of the hollow housing 14 and includes a forward end 176 and a rear end 178 which is unitary with the bight section 172. A rack 180 of a multiplicity of teeth is located on the first leg 174. The rack of teeth 180 on the first leg 174 extends between the forward end 176 of the first leg 174 and the rear end 178 of the first leg 174. Each tooth of the multiplicity of teeth of the rack 180 on the first leg 174 is triangular in shape and includes a forward end 182, a rear end 184, and an outer surface 186 which connects the rear end 184 to the forward end 182 of each tooth on the first leg 174. The rear end 184 of each tooth on the first leg 174 extends in the direction of the height axis 34 of the hollow housing 14 and the outer surface 186 of each tooth on the first leg 174 extends at an oblique angle to the rear end 184 of the tooth associated with the outer surface 186 of each tooth on the first leg 174.

A second leg 190 extends through second hole 50 defined through the rear wall 16 of the hollow housing 14 and into the lower guide groove 72 of the guide unit 60 of the hollow housing 14. The second leg 190 includes a forward end 192 and a rear end 194 which is unitary with the bight section 172. A rack 196 of a multiplicity of teeth is included on the second leg 190. The rack of teeth 196 on the second leg 190 extends between the forward end 192 of the second leg 190 and the rear end 194 of the second leg 190. Each tooth of the multiplicity of teeth of the rack 196 on the second leg 190 is triangular in shape and includes a forward end 198, a rear end 200, and an outer surface 202 which connects the rear end 200 of each tooth of the rack of teeth 196 on the second leg 190 to the forward end 198 of each tooth on the second leg 190. The rear end 200 of each tooth on the second leg 190 extends in the direction of the height axis 34 of the hollow housing 14 and the outer surface 202 of each tooth on the second leg 190 extends at an oblique angle to the rear end 200 of the tooth associated with the outer surface 202 of each tooth on the second leg 190.

A return spring 210 is mounted in blind-ended tube 154 mounted on the front wall 132 of the mechanism housing 120. The return spring 210 includes a rear end 212 which abuts the mechanism housing 120 and a front end 214 which abuts the front plate 110. The return spring 210 biases the mechanism housing 120 toward the rear position of the mechanism housing 120.

A trigger 220 is pivotally mounted on the hollow housing 14 to move between a forward position (see FIG. 4A) which is spaced apart from the handle 80 of the hollow housing 14 and a rear position (see FIG. 4B) which is located closely adjacent to the handle 80 of the hollow housing 14. The trigger 220 extends through the trigger slot 54 of the hollow housing 14. The trigger 220 has a top end 222 which is pivotally connected to the mechanism housing 120 to move the mechanism housing 120 against the bias of return spring 210 toward the forward location of the mechanism housing 120 when the trigger 220 is moved toward the rear position of the trigger 220.

A drive element-moving mechanism 230 is located in the mechanism housing 120. The drive element-moving mechanism 230 includes a first axle 232 mounted on the mechanism housing 120 and which extends in the direction of the transverse axis 138 of the mechanism housing 120 and is located near the top wall 122 of the mechanism housing 120.

Figure 4B:
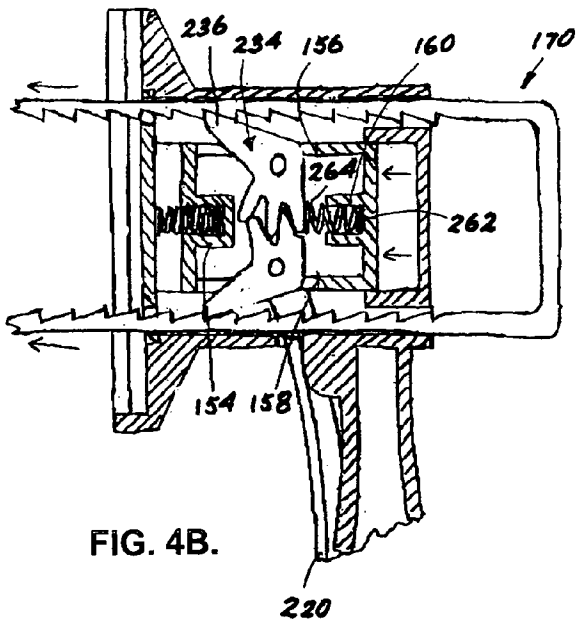
FIG. 4B is a view illustrating operation of the device embodying the present invention in a position during dispensing of product.
Figure 4A:
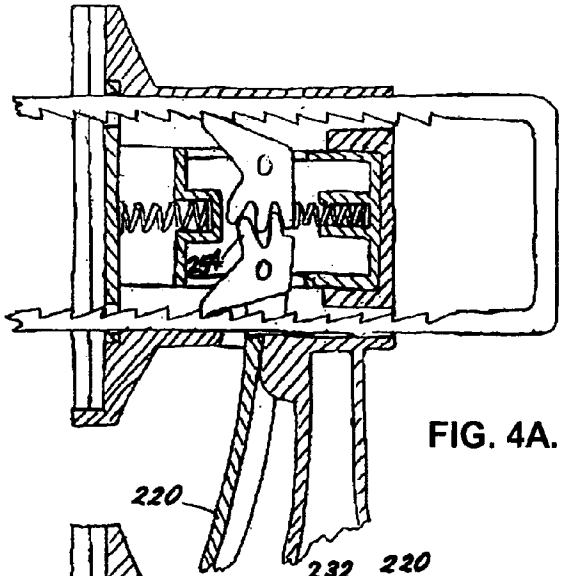
FIG. 4A is a view illustrating operation of the device embodying the present invention in a position ready to dispense product.

A first pawl 234 is mounted on the first axle 232 and includes a tooth-engaging leg 236 that extends through the opening 156 defined through the top wall 122 of the mechanism housing 120 and into a position that will engage the teeth on the first leg 174 of the drive element 170 as shown in FIGS. 4A and 4B. The first pawl 234 further includes a plurality of second teeth, such as tooth 238, that are located to be inside the mechanism housing 120 near the blind-ended tube 160 mounted on the rear wall 130 of the mechanism housing 120. The first pawl 234 is pivotally movable between a drive element-driving position shown in FIGS. 4A and 4B, with the tooth-engaging leg 236 of the first pawl 234 in engaging contact with the rear end 184 of one tooth on the first leg 174 of the drive element 170 and a drive element release position, shown in FIG. 4C, with the tooth-engaging leg 236 of the first pawl 234 spaced apart from a position in which the tooth-engaging leg 236 of the first pawl 234 is in engagement with the rear end 184 of a tooth on the first leg 174 of the drive element 170.

A second pawl 250 is mounted on the mechanism housing 120 and includes a tooth-engaging leg 252 that extends through the opening 158 defined through the bottom wall 124 of the mechanism housing 120 and into a position that will engage the teeth of the second leg 190 of the drive element 170. The second pawl 250 further includes a plurality of second teeth, such as tooth 254, that are located to be inside the mechanism housing 120 near the blind-ended tube 160 mounted on the rear wall 130 of the mechanism housing 120 and in meshing engagement with the second teeth of the first pawl 234. The second pawl 250 is pivotally movable between a drive element-driving position, shown in FIGS. 4A and 4B, with the tooth-engaging leg 252 of the second pawl 250 in engaging contact with the rear end 200 of one tooth on the second leg 190 of the drive element 170 and a drive element release position, shown in FIG. 4C, with the tooth-engaging leg 252 of the second pawl 250 spaced apart from a position in which the tooth-engaging leg 252 of the second pawl 250 is in engagement with the rear end 200 of a tooth on the second leg 190 of the drive element 170.

A pawl-biasing spring 260 is mounted in the blind-ended tube 160 mounted on the rear wall 130 of the mechanism housing 120. The pawl-biasing spring 260 has one end 262 abutting the rear wall 130 of the mechanism housing 120 and one end 264 abutting one tooth of the second teeth of the first pawl 234. The pawl-biasing spring 260 biases the first pawl 234 toward the drive element tooth-engaging position of the first pawl 234. The second pawl 250 is biased toward the drive element tooth-engaging position of the second pawl 250 by engagement of the second teeth of the second pawl 250 with the second teeth of the first pawl 234 when the first pawl 234 is biased toward the drive tooth-engaging position by the bias of the pawl-biasing spring 260.

A release lever 270 is mounted on the hollow housing 14 and includes a body 272 which extends through the slot 52 defined through the first side wall 22 of the hollow housing 14. Knurling 274 is located on body 272. The body 272 of the release lever 270 further extends through one hole of the two holes defined through the first side wall 126 of the mechanism housing 120 and engages the second pawl 250.

A handle 276 is on the body 272 of the release lever 270 and is located outside the hollow housing 14. The release lever 270 is moveably mounted on the hollow housing 14 to move between a forward position shown in dotted lines in FIG. 1 and indicated by reference number 270F, adjacent to the open front 28 of the hollow housing 14 and a rear position, shown in solid lines in FIG. 1, adjacent to the rear wall 16 of the hollow housing 14. The release lever 270 is mounted on the hollow housing 14 with the hollow housing 14 acting as a fulcrum to move the second pawl 250 into the drive element release position when the release lever 270 is moved into the forward position. The body 272 of the release lever 270 moves the second pawl 250 against the bias of the pawl-biasing spring 260. The first pawl 234 is moved into the drive element release position when the second pawl 250 is moved into the drive element release position by engagement of the second teeth of the second pawl 250 with the second teeth of the first pawl 234.

A mixing nozzle 280 includes a base 282 which has a rear portion 284 and a front portion 286. A product flow opening 288 is defined through the base 282. The base 282 is concave from the rear portion 284 toward the front portion 286 and further includes sides 290 and 292, a top 294, a bottom 296, and a collection area 298 defined on the rear portion 284 between the sides 290, 292, the top 294, and the bottom 296. The collection area 298 is fluidically connected to the product flow opening 288. The mixing nozzle 280 further includes a dispensing nozzle 300.

Figure 3:
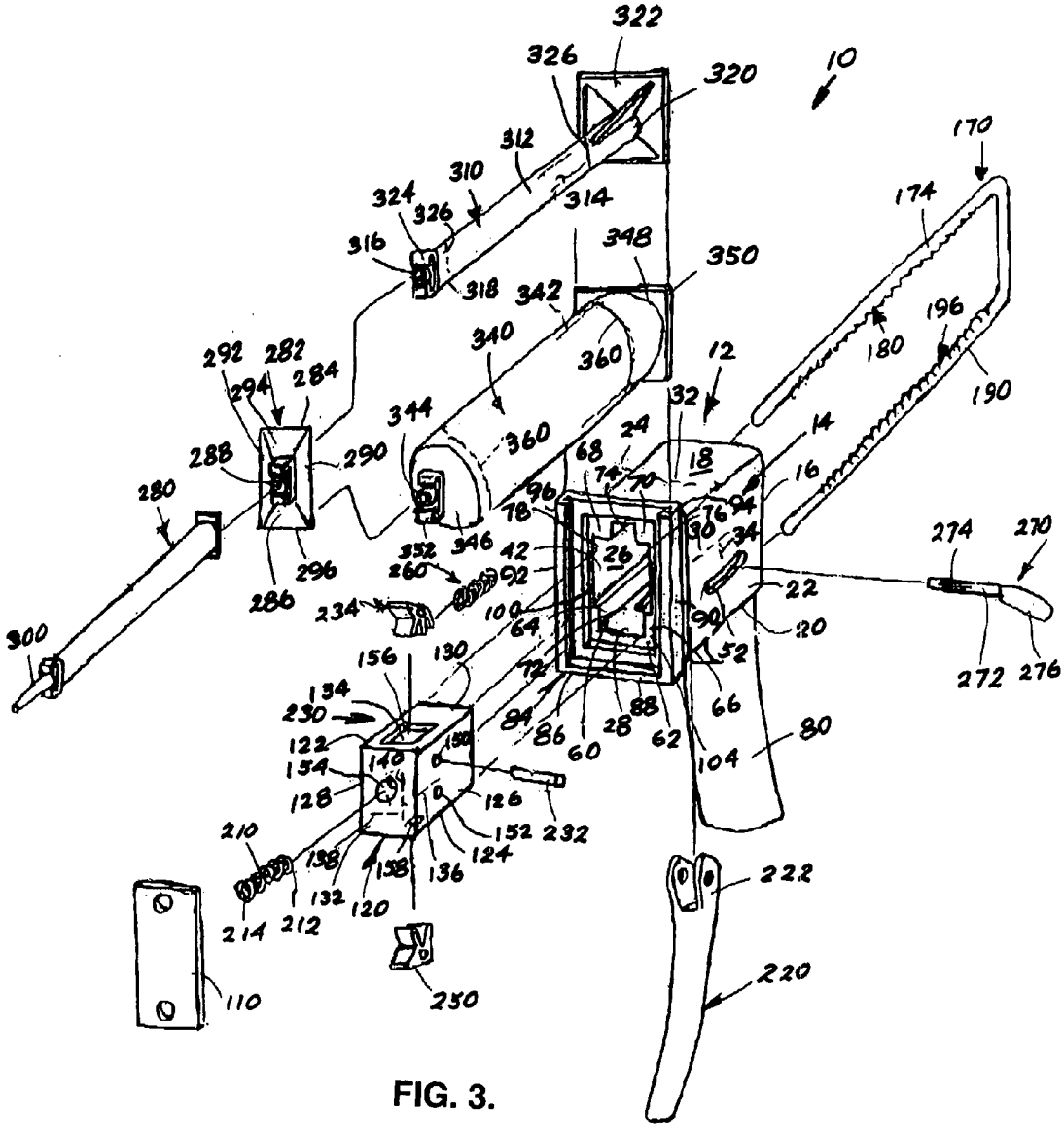
FIG. 3 is an exploded perspective view of the product-dispensing device embodying the present invention.

A first product container 310 is adapted to be mounted on the hollow housing 14. The first product container 310 includes a tubular body 312 having a product-containing bore 314 defined therein, an outlet nozzle 316, a forward end 318, a rear end 320, and a mounting flange 322 on the rear end 320 of the first product container 310. A mixing nozzle-connecting element 324 is located adjacent to the outlet nozzle 316 of the first product container 310. The mounting flange 322 of the first product container 310 is adapted to be slidably mounted in the channel-defining elements on the product container-mounting element 84. The first product container 310 further includes a product-moving plate 326 slidably located inside the tubular body 312 of the first product container 310. The product-moving plate 326 in the first product container 310 is adapted to be abuttingly contacted by the forward end 176 of the first leg 174 of the drive element 170. The product-moving plate 326 of the first product container 310 is movable between a full location shown in solid lines in FIG. 3, adjacent to the rear end 320 of the first product container 310 and an empty position, shown in dotted lines in FIG. 3, adjacent to the forward end 318 of the first product container 310. The product-moving plate 326 of the first product container 310 moves from the full location toward the empty location as the drive element 170 is moved from the retracted position toward the forward position under the influence of the trigger 220 via the drive element-moving mechanism 230 in the mechanism housing 120.

A second product container 340 is adapted to be mounted on the hollow housing 14. The second product container 340 includes a tubular body which has a product-containing bore 342 defined therein. An outlet nozzle 344 is mounted on the container 340. Container 340 further includes a forward end 346, a rear end 348, a mounting flange 350 on the rear end 348 of the second product container 340 and a mixing nozzle-connecting element 352 located adjacent to the outlet nozzle 344 of the second product container 340. The mounting flange 350 of the second product container 340 is adapted to be slidably mounted in the channel-defining elements on the product container-mounting element 84. The second product container 340 further includes a product-moving plate 360 which is slidably located inside the tubular body of the second product container 340. The product-moving plate 360 in the second product container 340 is adapted to be abuttingly contacted by the forward end 192 of the second leg 190 of the drive element 170. The product-moving plate 360 of the second product container 340 is movable between a full location shown in full lines in FIG. 3 adjacent to the rear end 348 of the second product container 340 and an empty position shown in dotted lines in FIG. 3 adjacent to the forward end 346 of the second product container 340. The product-moving plate 360 of the second product container 340 moves from the full location toward the empty location as the drive element 170 is moved from the retracted position toward the forward position under the influence of the trigger 220 via the drive element-moving mechanism 230 in the mechanism housing 120.

Figure 4C:
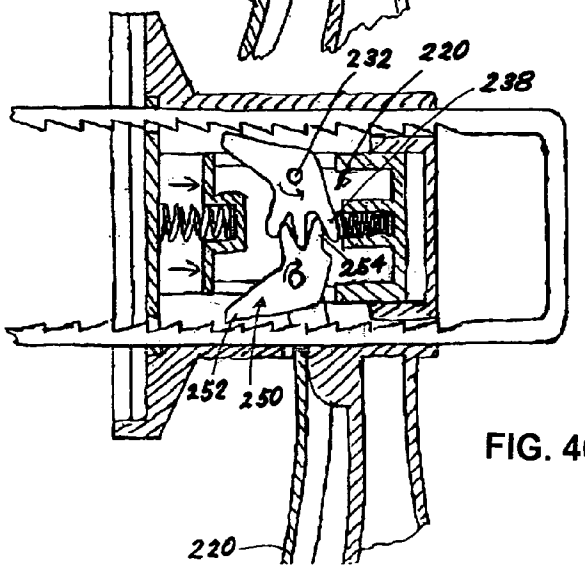
FIG. 4C is a view illustrating operation of the device embodying the present invention in a position during return to the initial position shown in FIG. 4A.

Operation of the device 10 will be understood from the foregoing and is indicated in FIGS. 4A through 4C in which the trigger 220 is moved from the position shown in FIG. 4A to the position shown in FIG. 4B to move the drive element 170 in the direction shown in FIG. 4B via rotation of the pawls 234, 250 and against the bias of spring 210. After the trigger 220 reaches the FIG. 4B position, the trigger 220 is released, and spring 210 moves the mechanism housing 120 back toward the FIG. 4A position while the legs of the pawls 234, 250 ride over the teeth on the legs 174, 190 of the drive element 170. Spring 260 then forces the teeth of the pawls 234, 250 back into tooth-engaging position once the mechanism housing 120 is back in the position of FIG. 4C. Once the drive element 170 has been fully moved to the position shown in FIG. 4C, the release lever 270 can be operated to force the pawls 234, 250 back into the position of FIG. 4C so the drive element 170 can be pulled out of the hollow housing 14.

It is noted that while the above disclosure described two product containers, the device 10 can be used with a single product container as well. One leg of the drive element 170 will engage the product container while the other leg does not engage anything.

The product containers can be of different sizes if desired as indicated in FIG. 1, or they can be the same size. The nozzles on the product containers can be adjusted to adjust the ratio of product dispensed from nozzle 300. Various products can also be combined to produce a desired overall product. Thus, for example, in some cases adhesives are administered in two parts and device 10 can effect such an application of multiple parts.

It is understood that while certain forms of the present invention have been illustrated and described herein, it is not to be limited to the specific forms or arrangements of parts described and shown.

What is claimed and desired to be covered by Letters Patent is:

1. A device for dispensing product such as sealants and/or adhesives in various ratios comprising:

a) a handle unit which includes (1) a hollow housing having a rear wall, a top wall, a bottom wall, first and second side walls, a hollow interior defined between the rear wall, the top wall, the bottom wall and the first and second side walls, an open front, a longitudinal axis extending between the rear wall and the open front, a transverse axis extending between the first and second side walls, a height axis extending between the top wall and the bottom wall, an interior surface on the top wall adjacent to the hollow interior, an interior surface on each side wall of the first and side walls adjacent to the hollow interior, an interior surface on the bottom wall adjacent to the hollow interior, an interior surface on the rear wall adjacent to the hollow interior, a first hole defined through the rear wall adjacent to the top wall, a second hole defined through the rear wall adjacent to the bottom wall, a slot defined through the first side wall and extending in the direction of the longitudinal axis, and a trigger slot defined through the bottom wall, (2) a guide unit mounted in the hollow interior of the hollow housing, the guide unit including a front end located adjacent to the open front of the hollow housing, first and second guide rails extending between the open front and the rear wall of the hollow housing adjacent to the interior surfaces of the first and second side walls near the bottom wall, third and fourth guide rails extending between the open front and the rear wall of the hollow housing adjacent to the interior surfaces of the first and second side walls near the top wall, a lower guide groove located near the interior surface of the bottom wall between the first and second guide rails, an upper guide groove located near the interior surface of the top wall between the third and fourth guide rails, a first side guide groove located near the first side wall of the hollow housing between the first and third guide rails, a second side guide groove located near the second side wall of the hollow housing between the second and fourth guide rails, and (3) a handle attached to the bottom wall of the hollow housing;

b) a product container-mounting element mounted on the hollow housing adjacent to the open front of the hollow housing and including a base portion, a bottom portion, a first side, a second side, a first channel-defining element on the first side of the product container-mounting element, a second channel-defining element on the second side of the product container-mounting element, and a passage defined through the product container-mounting element and which forms a continuation of the hollow interior of the hollow housing when the product container-mounting element is mounted on the hollow housing, the passage defined through the product container-mounting element being contained in a plane, and the guide rails each having an end that is located adjacent to the plane containing the passage, the guide grooves extending between the open front of the hollow housing and the rear wall of the hollow housing;

c) a front plate attached to said hollow housing to cover the open front of said hollow housing when said front plate is in place on said hollow housing;

d) a mechanism housing slidably mounted in the hollow interior of said hollow housing on the guide rails in the first and second side guide grooves to move between a forward location adjacent to the open front of said hollow housing and a rear position adjacent to the rear wall of said hollow housing, said mechanism housing including a top wall, a bottom wall, a first side wall, a second side wall, a rear end wall, a front end wall, a hollow interior, a longitudinal axis extending between the front end wall of said mechanism housing and the rear end wall of said mechanism housing, the longitudinal axis of said mechanism housing extending in the direction of the longitudinal axis of said hollow housing when said mechanism housing is mounted inside said hollow housing, a transverse axis extending between the first side wall of said mechanism housing and the second side wall of said mechanism housing, the transverse axis of said mechanism housing extending in the direction of the transverse axis of said hollow housing when said mechanism housing is mounted inside said hollow housing, a height axis extending between the top wall of said mechanism housing and the bottom wall of said mechanism housing, the height axis of said mechanism housing extending in the direction of the height axis of said hollow housing when said mechanism housing is mounted inside said hollow housing, two holes defined through the first side wall of said mechanism housing and being spaced apart from each other in the direction of the height axis of said mechanism housing, a blind-ended tube mounted on the front wall of said mechanism housing and extending into the hollow interior of said mechanism housing, an opening defined through the top wall of said mechanism housing, an opening defined through the bottom wall of said mechanism housing, and a blind-ended tube mounted on the rear wall of said mechanism housing in the hollow interior of said mechanism housing, the blind-ended tube on the rear wall of said mechanism housing being aligned with the blind-ended tube mounted on the front wall of said mechanism housing;

e) a U-shaped drive element slidably mounted on said hollow housing to move in the direction of the longitudinal axis of said hollow housing between a retracted position and a forward position on said hollow housing, said U-shaped drive element including (1) a bight section, the bight section being located closely adjacent to the rear wall of said hollow housing when said drive element is in the forward position and being spaced apart from the rear wall of said hollow housing when said drive element is in the retracted position, (2) a first leg which extends through the first hole defined through the rear wall of said hollow housing and into the upper guide groove of the guide unit of said hollow housing and which includes a forward end, a rear end which is unitary with the bight section, a rack of a multiplicity of teeth, the rack of teeth on the first leg extending between the forward end of the first leg and the rear end of the first leg, each tooth of the multiplicity of teeth of the rack on the first leg being triangular in shape and including a forward end, a rear end, an outer surface connecting the rear end to the forward end of each tooth on the first leg, with the rear end of each tooth on the first leg extending in the direction of the height axis of said hollow housing and the outer surface of each tooth on the first leg extending at an oblique angle to the rear end of the tooth associated with the outer surface of each tooth on the first leg, and (3) a second leg which extends through the second hole defined through the rear wall of said hollow housing and into the lower guide groove of the guide unit of said hollow housing and which includes a forward end, a rear end which is unitary with the bight section, a rack of a multiplicity of teeth, the rack of teeth on the second leg extending between the forward end of the second leg and the rear end of the second leg, each tooth of the multiplicity of teeth of the rack on the second leg being triangular in shape and including a forward end, a rear end, an outer surface connecting the rear end of each tooth of the rack of teeth on the second leg to the forward end of each tooth on the second leg, with the rear end of each tooth on the second leg extending in the direction of the height axis of said hollow housing and the outer surface of each tooth on the second leg extending at an oblique angle to the rear end of the tooth associated with the outer surface of each tooth on the second leg;

f) a return spring mounted in the blind-ended tube mounted on the front wall of said mechanism housing, said return spring including a rear end abutting said mechanism housing and a front end abutting said front plate, said return spring biasing said mechanism housing toward the rear position of said mechanism housing;

g) a trigger pivotally mounted on said hollow housing to move between a forward position which is spaced apart from the handle of said hollow housing and a rear position which is located closely adjacent to the handle of said hollow housing, said trigger extending through the trigger slot of said hollow housing, said trigger having a top end pivotally connected to said mechanism housing to move said mechanism housing against the bias of said return spring toward the forward location of said mechanism housing when said trigger is moved toward the rear position of said trigger;

h) drive element-moving mechanism in said mechanism housing, said drive element-moving mechanism including (1) a first axle mounted on said mechanism housing and extending in the direction of the transverse axis of said mechanism housing near the top wall of said mechanism housing, (2) a first pawl mounted on the first axle and including a tooth-engaging leg that extends through the opening defined through the top wall of said mechanism housing and into a position that will engage the teeth on the first leg of said drive element, the first pawl further including a plurality of second teeth that are located to be inside said mechanism housing near the blind-ended tube mounted on the rear wall of said mechanism housing, the first pawl being pivotally movable between a drive element driving position with the tooth-engaging leg of the first pawl in engaging contact with the rear end of one tooth on the first leg of said drive element and a drive element release position with the tooth-engaging leg of the first pawl spaced apart from a position in which the tooth-engaging leg of the first pawl is in engagement with the rear end of a tooth on the first leg of said drive element, (3) a second pawl mounted on said mechanism housing and including a tooth-engaging leg that extends through the opening defined through the bottom wall of said mechanism housing and into a position that will engage the teeth of the second leg of said drive element, the second pawl further including a plurality of second teeth that are located to be inside said mechanism housing near the blind-ended tube mounted on the rear wall of said mechanism housing and in meshing engagement with the second teeth of the first pawl, the second pawl being pivotally movable between a drive element driving position with the tooth engaging leg of the second pawl in engaging contact with the rear end of one tooth on the second leg of said drive element and a drive element release position with the tooth engaging leg of the second pawl spaced apart from a position in which the tooth engaging leg of the second pawl is in engagement with the rear end of a tooth on the second leg of said drive element, and (4) a pawl-biasing spring mounted in the blind-ended tube mounted on the rear wall of said mechanism housing, the pawl-biasing spring having one end abutting the rear wall of said mechanism housing and one end abutting one tooth the second teeth of the first pawl, the pawl-biasing spring biasing the first pawl toward the drive element tooth-engaging position of the first pawl, the second pawl being biased toward the drive element tooth-engaging position of the second pawl by engagement of the second teeth of the second pawl with the second teeth of the first pawl when the first pawl is biased toward the drive tooth-engaging position by the bias of said pawl-biasing spring;

i) a release lever mounted on said hollow housing and including (1) a body which extends through the slot defined through the first side wall of said hollow housing, and including knurling thereon, the body of said release lever further extending through one hole of the two holes defined through the first side wall of said mechanism housing and engaging the second pawl, (2) a handle on the body of said release lever and located outside said hollow housing, (3) said release lever being moveably mounted on said hollow housing to move between a forward position adjacent to the open front of said hollow housing and a rear position adjacent to the rear wall of said hollow housing, and (4) said release lever being mounted on said hollow housing with said hollow housing acting as a fulcrum to move the second pawl into the drive element release position when said release lever is moved into the forward position, the body of the release lever moving said second pawl against the bias of the pawl-biasing spring, the first pawl being moved into the drive element release position when the second pawl is moved into the drive element release position by engagement of the second teeth of the second pawl with the second teeth of the first pawl;

j) a mixing nozzle which includes a base having a rear portion and a front portion, a product flow opening through the base, the base being concave from the rear portion toward the front portion, sides, a top, a bottom, and a collection area defined on the rear portion between the sides the top and the bottom, the collection area being fluidically connected to the product flow opening, said mixing nozzle further including a dispensing nozzle;

k) a first product container adapted to be mounted on said hollow housing, said first product container including a tubular body having a product-containing bore defined therein, an outlet nozzle, a forward end, a rear end, a mounting flange on the rear end of said first product container, and a mixing nozzle-connecting element located adjacent to the outlet nozzle of said first product container, the mounting flange of said first product container being adapted to be slidably mounted in the channel-defining elements on said product container-mounting element, said first product container further including a product-moving plate slidably located inside the tubular body of said first product container, the product-moving plate in said first product container being adapted to be abuttingly contacted by the forward end of the first leg of said drive element, the product-moving plate of said first product container being movable between a full location adjacent to the rear end of said first product container and an empty position adjacent to the forward end of said first product container, the product-moving plate of said first product container moving from the full location toward the empty location as said drive element is moved from the retracted position toward the forward position under the influence of said trigger via said drive element-moving mechanism in said mechanism housing; and l) a second product container adapted to be mounted on said hollow housing, said second product container including a tubular body having a product-containing bore defined therein, an outlet nozzle, a forward end, a rear end, a mounting flange on the rear end of said second product container, and a mixing nozzle-connecting element located adjacent to the outlet nozzle of said second product container, the mounting flange of said second product container being adapted to be slidably mounted in the channel-defining elements on said product container-mounting element, said second product container further including a product-moving plate slidably located inside the tubular body of said second product container, the product-moving plate in said second product container being adapted to be abuttingly contacted by the forward end of the second leg of said drive element, the product-moving plate of said second product container being movable between a full location adjacent to the rear end of said second product container and an empty position adjacent to the forward end of said second product container, the product-moving plate of said second product container moving from the full location toward the empty location as said drive element is moved from the retracted position toward the forward position under the influence of said trigger via said drive element-moving mechanism in said mechanism housing.

2. The device as described in claim 1 wherein said second product container is larger than said first product container.

3. A device for dispensing product such as sealants and/or adhesives in various ratios comprising:

a) a handle unit which includes (1) a hollow housing having a rear wall, a top wall, a bottom wall, first and second side walls, a hollow interior defined between the rear wall the top wall the bottom wall and the first and second side walls, an open front, a longitudinal axis extending between the rear wall and the open front, a transverse axis extending between the first and second side walls, a height axis extending between the top wall and the bottom wall, an interior surface on the top wall adjacent to the hollow interior, an interior surface on each side wall of the first and side walls adjacent to the hollow interior, an interior surface on the bottom wall adjacent to the hollow interior, an interior surface on the rear wall adjacent to the hollow interior, a first hole defined through the rear wall adjacent to the top wall, a second hole defined through the rear wall adjacent to the bottom wall, a slot defined through the first side wall and extending in the direction of the longitudinal axis, and a trigger slot defined through the bottom wall, (2) a guide unit mounted in the hollow interior of the hollow housing, the guide unit including a front end located adjacent to the open front of the hollow housing, first and second guide rails extending between the open front and the rear wall of the hollow housing adjacent to the interior surfaces of the first and second side walls near the bottom wall, third and fourth guide rails extending between the open front and the rear wall of the hollow housing adjacent to the interior surfaces of the first and second side walls near the top wall, a lower guide groove located near the interior surface of the bottom wall between the first and second guide rails, an upper guide groove located near the interior surface of the top wall between the third and fourth guide rails, a first side guide groove located near the first side wall of the hollow housing between the first and third guide rails, a second side guide groove located near the second side wall of the hollow housing between the second and fourth guide rails, and (3) a handle attached to the bottom wall of the hollow housing;

b) a product container-mounting element mounted on the hollow housing adjacent to the open front of the hollow housing and including a base portion, a bottom portion, a first side, a second side, a first channel-defining element on the first side of the product container-mounting element, a second channel-defining element on the second side of the product container-mounting element, and a passage defined through the product container-mounting element and which forms a continuation of the hollow interior of the hollow housing when the product container-mounting element is mounted on the hollow housing, the passage defined through the product container-mounting element being contained in a plane, and the guide rails each having an end that is located adjacent to the plane containing the passage, the guide grooves extending between the open front of the hollow housing and the rear wall of the hollow housing;

c) a front plate attached to said hollow housing to cover the open front of said hollow housing when said front plate is in place on said hollow housing;

d) a mechanism housing slidably mounted in the hollow interior of said hollow housing on the guide rails in the first and second side guide grooves to move between a forward location adjacent to the open front of said hollow housing and a rear position adjacent to the rear wall of said hollow housing, said mechanism housing including a top wall, a bottom wall, a first side wall, a second side wall, a rear end wall, a front end wall, a hollow interior, a longitudinal axis extending between the front end wall of said mechanism housing and the rear end wall of said mechanism housing, the longitudinal axis of said mechanism housing extending in the direction of the longitudinal axis of said hollow housing when said mechanism housing is mounted inside said hollow housing, a transverse axis extending between the first side wall of said mechanism housing and the second side wall of said mechanism housing, the transverse axis of said mechanism housing extending in the direction of the transverse axis of said hollow housing when said mechanism housing is mounted inside said hollow housing, a height axis extending between the top wall of said mechanism housing and the bottom wall of said mechanism housing, the height axis of said mechanism housing extending in the direction of the height axis of said hollow housing when said mechanism housing is mounted inside said hollow housing, two holes defined through the first side wall of said mechanism housing and being spaced apart from each other in the direction of the height axis of said mechanism housing, a blind-ended tube mounted on the front wall of said mechanism housing and extending into the hollow interior of said mechanism housing, an opening defined through the top wall of said mechanism housing, an opening defined through the bottom wall of said mechanism housing, and a blind-ended tube mounted on the rear wall of said mechanism housing in the hollow interior of said mechanism housing, the blind-ended tube on the rear wall of said mechanism housing being aligned with the blind-ended tube mounted on the front wall of said mechanism housing;

e) a U-shaped drive element slidably mounted on said hollow housing to move in the direction of the longitudinal axis of said hollow housing between a retracted position and a forward position on said hollow housing, said U-shaped drive element including (1) a bight section, the bight section being located closely adjacent to the rear wall of said hollow housing when said drive element is in the forward position and being spaced apart from the rear wall of said hollow housing when said drive element is in the retracted position, (2) a first leg which extends through the first hole defined through the rear wall of said hollow housing and into the upper guide groove of the guide unit of said hollow housing and which includes a forward end, a rear end which is unitary with the bight section, a rack of a multiplicity of teeth, the rack of teeth on the first leg extending between the forward end of the first leg and the rear end of the first leg, each tooth of the multiplicity of teeth of the rack on the first leg being triangular in shape and including a forward end, a rear end, an outer surface connecting the rear end to the forward end of each tooth on the first leg, with the rear end of each tooth on the first leg extending in the direction of the height axis of said hollow housing and the outer surface of each tooth on the first leg extending at an oblique angle to the rear end of the tooth associated with the outer surface of each tooth on the first leg, and (3) a second leg which extends through the second hole defined through the rear wall of said hollow housing and into the lower guide groove of the guide unit of said hollow housing and which includes a forward end, a rear end which is unitary with the bight section, a rack of a multiplicity of teeth, the rack of teeth on the second leg extending between the forward end of the second leg and the rear end of the second leg, each tooth of the multiplicity of teeth of the rack on the second leg being triangular in shape and including a forward end, a rear end, an outer surface connecting the rear end of each tooth of the rack of teeth on the second leg to the forward end of each tooth on the second leg, with the rear end of each tooth on the second leg extending in the direction of the height axis of said hollow housing and the outer surface of each tooth on the second leg extending at an oblique angle to the rear end of the tooth associated with the outer surface of each tooth on the second leg;

f) a return spring mounted in the blind-ended tube mounted on the front wall of said mechanism housing, said return spring including a rear end abutting said mechanism housing and a front end abutting said front plate, said return spring biasing said mechanism housing toward the rear position of said mechanism housing;

g) a trigger pivotally mounted on said hollow housing to move between a forward position which is spaced apart from the handle of said hollow housing and a rear position which is located closely adjacent to the handle of said hollow housing, said trigger extending through the trigger slot of said hollow housing, said trigger having a top end pivotally connected to said mechanism housing to move said mechanism housing against the bias of said return spring toward the forward location of said mechanism housing when said trigger is moved toward the rear position of said trigger;

h) drive element-moving mechanism in said mechanism housing, said drive element-moving mechanism including (1) a first axle mounted on said mechanism housing and extending in the direction of the transverse axis of said mechanism housing near the top wall of said mechanism housing, (2) a first pawl mounted on the first axle and including a tooth-engaging leg that extends through the opening defined through the top wall of said mechanism housing and into a position that will engage the teeth on the first leg of said drive element, the first pawl further including a plurality of second teeth that are located to be inside said mechanism housing near the blind-ended tube mounted on the rear wall of said mechanism housing, the first pawl being pivotally movable between a drive element driving position with the tooth-engaging leg of the first pawl in engaging contact with the rear end of one tooth on the first leg of said drive element and a drive element release position with the tooth-engaging leg of the first pawl spaced apart from a position in which the tooth-engaging leg of the first pawl is in engagement with the rear end of a tooth on the first leg of said drive element, (3) a second pawl mounted on said mechanism housing and including a tooth-engaging leg that extends through the opening defined through the bottom wall of said mechanism housing and into a position that will engage the teeth of the second leg of said drive element, the second pawl further including a plurality of second teeth that are located to be inside said mechanism housing near the blind-ended tube mounted on the rear wall of said mechanism housing and in meshing engagement with the second teeth of the first pawl, the second pawl being pivotally movable between a drive element driving position with the tooth-engaging leg of the second pawl in engaging contact with the rear end of one tooth on the second leg of said drive element and a drive element release position with the tooth-engaging leg of the second pawl spaced apart from a position in which the tooth-engaging leg of the second pawl is in engagement with the rear end of a tooth on the second leg of said drive element, and (4) a pawl-biasing spring mounted in the blind-ended tube mounted on the rear wall of said mechanism housing, the pawl-biasing spring having one end abutting the rear wall of said mechanism housing and one end abutting one tooth of the second teeth of the first pawl, the pawl-biasing spring biasing the first pawl toward the drive element tooth-engaging position of the first pawl, the second pawl being biased toward the drive element tooth-engaging position of the second pawl by engagement of the second teeth of the second pawl with the second teeth of the first pawl when the first pawl is biased toward the drive element tooth-engaging position by the bias of said pawl-biasing spring;

i) a release lever mounted on said hollow housing and including (1) a body which extends through the slot defined through the first side wall of said hollow housing, and including knurling thereon, the body of said release lever further extending through one hole of the two holes defined through the first side wall of said mechanism housing and engaging the second pawl, (2) a handle on the body of said release lever and located outside said hollow housing, (3) said release lever being moveably mounted on said hollow housing to move between a forward position adjacent to the open front of said hollow housing and a rear position adjacent to the rear wall of said hollow housing, and (4) said release lever being mounted on said hollow housing with said hollow housing acting as a fulcrum to move the second pawl into the drive element release position when said release lever is moved into the forward position, the body of the release lever moving said second pawl against the bias of the pawl-biasing spring, the first pawl being moved into the drive element release position when the second pawl is moved into the drive element release position by engagement of the second teeth of the second pawl with the second teeth of the first pawl;

j) a mixing nozzle which includes a base having a rear portion and a front portion, a product flow opening through the base, the base being concave from the rear portion toward the front portion, sides, a top, a bottom, and a collection area defined on the rear portion between the sides the top and the bottom, the collection area being fluidically connected to the product flow opening, said mixing nozzle further including a dispensing nozzle; and k) a product container adapted to be mounted on said hollow housing, said product container including a tubular body having a product-containing bore defined therein, an outlet nozzle, a forward end, a rear end, a mounting flange on the rear end of said product container, and a mixing nozzle-connecting element located adjacent to the outlet nozzle of said product container, the mounting flange of said product container being adapted to be slidably mounted in the channel-defining elements on said product container-mounting element, said product container further including a product-moving plate slidably located inside the tubular body of said product container, the product-moving plate in said product container being adapted to be abuttingly contacted by the forward end of the first leg of said drive element, the product-moving plate of said product container being movable between a full location adjacent to the rear end of said product container and an empty position adjacent to the forward end of said product container, the product-moving plate of said product container moving from the full location toward the empty location as said drive element is moved from the retracted position toward the forward position under the influence of said trigger via said drive element-moving mechanism in said mechanism housing.

4. A device for dispensing product such as sealants and/or adhesives in various ratios comprising:

a) a handle unit;

b) a product container-mounting element mounted on said handle unit;

c) a U-shaped drive element slidably mounted on said handle unit to move between a retracted position and a forward position, said drive element including a bight section and two legs, and a plurality of teeth on each leg;

d) a trigger pivotally mounted on said hollow housing to move between a drive position and a release position;

e) a drive element-moving mechanism in said handle unit, said trigger being connected to said drive element-moving mechanism, said drive element-moving mechanism being connected to said drive element to move said drive element from the retracted position to the forward position;

f) a return spring connected to said drive element-moving mechanism and to said handle, said trigger moving said drive element-moving mechanism against the bias of said return spring;

g) two pawls in said drive element-moving mechanism, each pawl being movable between a drive element driving position and a drive element release position and having pawl teeth engaging pawl teeth of the other pawl and a tooth-engaging leg which is located to engage a tooth of the teeth on the legs of said drive element when in the drive element driving position;

h) a pawl control spring mounted on said handle unit and abutting one of said pawls, said pawl control spring biasing said pawls toward the drive element driving position;

i) a release lever mounted on said handle and connected to said pawls to move those pawls into a drive element release position when said release lever is activated; and j) a product container adapted to be mounted on said product container-mounting element on said handle in a position to be engaged by one leg of said drive element as said drive element is moved toward the forward position of said drive element.

* * * * *